US006405392B2

(12) United States Patent
Schwalbe, Jr.

(10) Patent No.: US 6,405,392 B2
(45) Date of Patent: Jun. 18, 2002

(54) PORTABLE BED

(76) Inventor: Allen F. Schwalbe, Jr., 129 Lake June Rd. NW., Lake Placid, FL (US) 33852

( * ) Notice: Subject to any disclaimer, the term of this patent is extended or adjusted under 35 U.S.C. 154(b) by 0 days.

(21) Appl. No.: 09/793,189

(22) Filed: Feb. 26, 2001

Related U.S. Application Data

(60) Provisional application No. 60/185,576, filed on Feb. 28, 2000.

(51) Int. Cl.[7] ..... A47C 17/38

(52) U.S. Cl. ..... 5/136; 5/133; 5/166.1

(58) Field of Search ..... 5/136, 137, 166.1, 5/164.1; 74/573 F, 589, 590; 248/325, 364

(56) References Cited

U.S. PATENT DOCUMENTS

| | | | | |
|---|---|---|---|---|
| 181,450 A | | 8/1876 | Kilburn | |
| 244,567 A | | 7/1881 | Doring | |
| 373,599 A | | 11/1887 | Owen | |
| 380,223 A | | 3/1888 | Smith et al. | |
| 409,606 A | | 8/1889 | Hale | |
| 916,923 A | | 3/1909 | Edmunds | |
| 950,362 A | | 2/1910 | Anderson | |
| 1,056,647 A | | 3/1913 | Douglass | |
| 1,456,988 A | | 5/1923 | McAllaster | |
| 2,724,128 A | | 11/1955 | Schulz | |
| 3,041,070 A | * | 6/1962 | Kerstein | 297/271.5 |
| 4,258,952 A | * | 3/1981 | Dutra | 248/364 |

* cited by examiner

*Primary Examiner*—Jack Lavinder
*Assistant Examiner*—Fredrick Conley
(74) *Attorney, Agent, or Firm*—William M. Hobby, III

(57) ABSTRACT

A bed apparatus is pivotal from a horizontal position to a generally upright position and has a base frame with a mattress supporting platform hinged thereto for pivoting between a generally horizontal position and a generally upright position. A counterweight container has a generally flat side intersected along two edges by a generally arcuate side. The container has a sealable opening adjacent one intersecting edge of the intersecting arcuate and flat sides. The sealable opening is positioned above the fluid material in the container in both the horizontal and upright positions to thereby prevent leakage from the sealable opening and to allow filling the container from either position.

4 Claims, 3 Drawing Sheets

PORTABLE BED

PARENT CASE

This application claims benefit of provisional Application Ser. No. 60/185,576 filed Feb. 28, 2000.

BACKGROUND OF THE INVENTION

The present invention relates to a storable bed and especially to a bed which is pivotal from a horizontal position to an upright storage position.

The commonly known Murphy Bed or "Wall Bed" was invented by William L. Murphy of California in the early 1900's. His design, still in use today, utilizes a bed frame that pivots upward into a vertical position for storage when not in use as a bed. For sleeping, the bed is pivoted downward to a horizontal position. To assist the user in raising and lowering the bed, a set of tension springs are employed to offset the weight of the mattress/foundation and bed frame, thereby reducing the required physical effort. The springs are, in essence, attached to the floor of the building by means of a steel base frame. This steel base frame is attached to the floor with a minimum of six bolts. In the case of a concrete floor, holes are drilled into the concrete and specialized expanding anchor bolts are utilized for fastening. For wood floors (including hardwood), lag bolts are screwed directly into the floor. If the floor is carpeted, the carpet and padding must be cut so that the steel frame can be placed directly against the underlying floor for bolting.

Beds of this type are available in various standard sizes from different manufacturers. The primary benefit of the Murphy Bed/Wall Bed design is that it folds up against the wall when not in use providing a space saving advantage over conventional beds. The major disadvantages are that, due to the requirement for mounting to the floor, the bed cannot be easily relocated and the mounting bolts damage carpets and floors.

Prior art patents for Murphy type beds can be seen in the U.S. Pat. No. 373,599 to Owen for a counterweighted folding bed and in the U.S. Pat. No. 181,450 to Kilburn for a wardrobe bedstead. The I. C. Smith & E. E. Herrinton U.S. Pat. No. 380,223 is for a folding bed which has a plurality of boxes for holding sand or the like as a counterweight. The U.S. Pat. No. 409,606 to Hale is a folding bedstead having counterweights as is the Edmunds U.S. Pat. No. 916,923. The Schulz U.S. Pat. No. 2,724,128 is a covered bed having a counterweight which also suggests the use of a container filled with a pulverized material as a counterweight. The Anderson U.S. Pat. No. 950,362 is a recess bed while the Doring U.S. Pat. No. 244,567 is a wardrobe bedstead. The McAllaster U.S. Pat. No. 1,456,988 is a folding bed as in the Douglass U.S. Pat. No. 1,056,647 for a wall bed.

The present invention is for a Murphy type pivotal bed which swings from a horizontal position to an upright position for storage in the upright position and uses a counterweighted container filled with a fluid material for counterweighting the bed for pivoting from a horizontal to an upright position. The container has a sealable opening adjacent an intersecting edge of the container positioned above the fluid material in the container in both the horizontal and upright positions to prevent leakage from the opening.

SUMMARY OF THE INVENTION

A stowable bed apparatus is pivotal from a horizontal bed position to a generally upright storage position and has a base frame with a mattress supporting platform hinged thereto for pivoting between a generally horizontal position and a generally upright position. A counterweight container has a generally flat side intersected along two edges by a generally arcuate side. The container has a sealable opening adjacent one intersecting edge of the flat and arcuate sides for filling the container with a fluid material. The sealable opening is positioned above the fluid material level in the container in both the horizontal and upright positions to thereby prevent leakage from the sealable opening and to allow filling the container from either position.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 3:
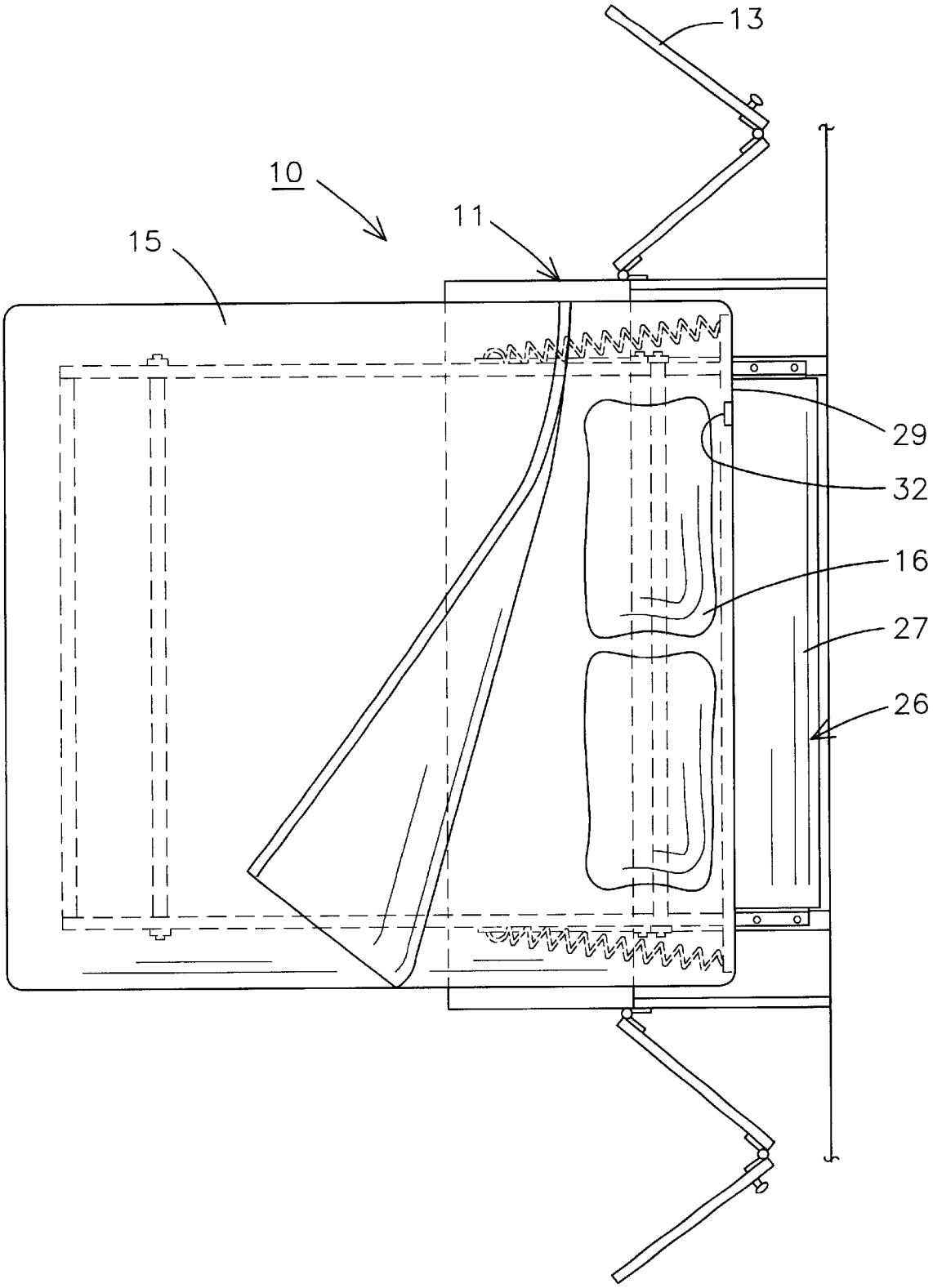
FIG. 3 is a top plan view of the stowable bed of FIG. 1 having the bed platform in a horizontal position.
Figure 4:
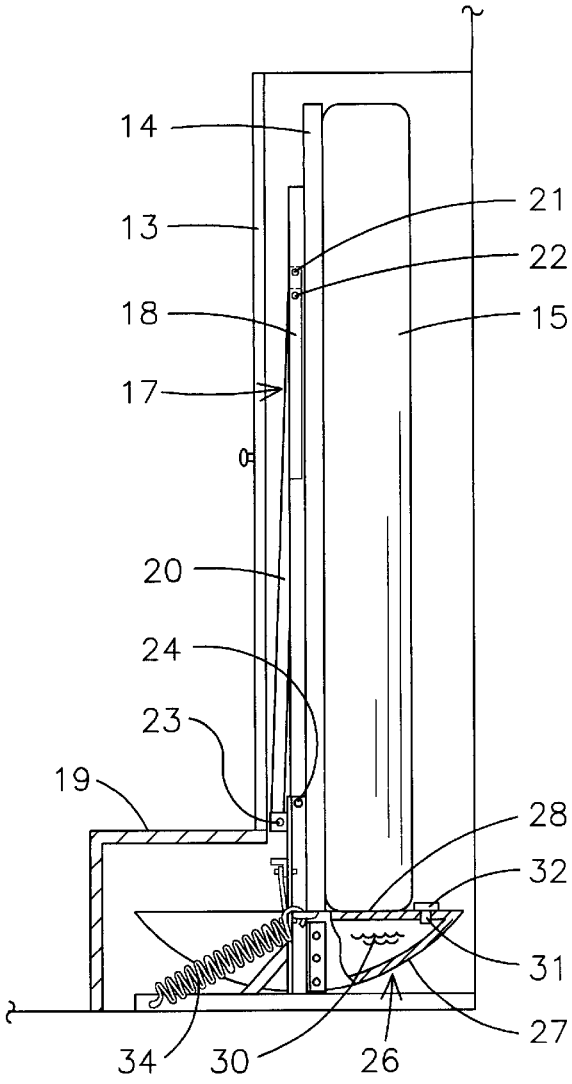
FIG. 4 is a side sectional view of the stowable bed of FIGS. 1–3 in a stored position.
Figure 5:
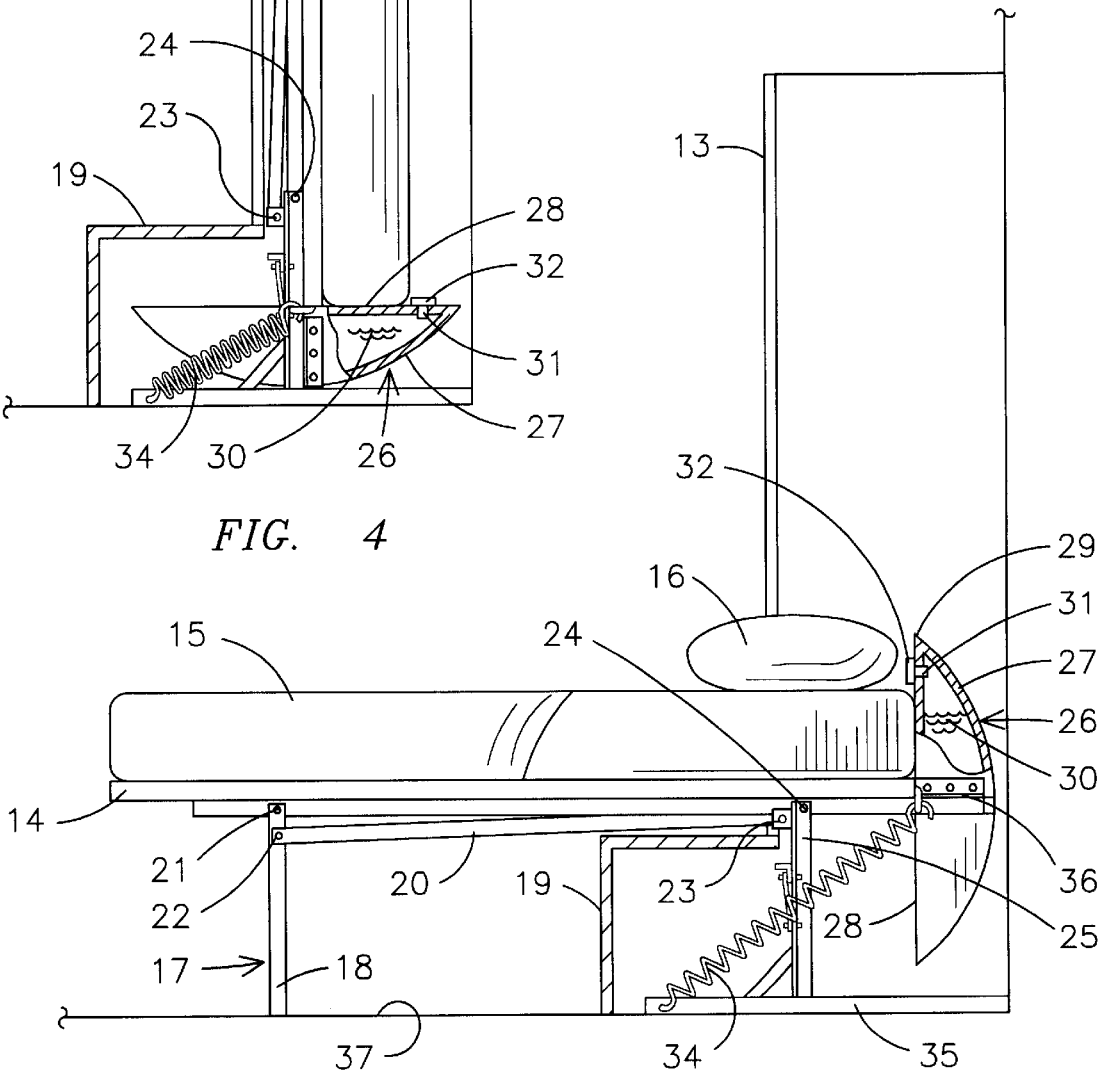
FIG. 5 is a sectional view of a stowable bed in accordance with FIGS. 1–4 having the platform in a horizontal position.

Referring to the drawings FIGS. 1–5, a stowable bed and cabinet 10 has a cabinet 11 with a stowable bed 12 stored therein. The cabinet 11 has a plurality of doors 13 which open to allow the bed to be folded down. Cabinet 11 also has a protruding lower cabinet 19 which can advantageously be used as a seat where the bed is stored in the cabinet. The stowable bed 12 includes a bed platform 14 having a mattress 15 thereon and can have a pillow 16. The platform 14 has a foldable frame 17 mounted thereunderneath which includes a pair of support legs 18 along with a frame folding link 20. The leg 18 is mounted to a pivoting hinge 21 while the link 20 is connected between pivot pins 22 and 23. The platform 14 has pivot pins 24 attached to an upright turning member 25 pivoting the platform 14 between a horizontal bed position, as shown in FIG. 5, to an upright storage position, as shown in FIG. 4, where it is stored in cabinet 11. The horizontal platform 14 has a counterweight container 26 thereon having an arcuate side 27 and a generally flat side 28. Container 26 holds a fluid material 30, such as water. A filling opening 31 has a sealing cap 32 therein and is positioned adjacent an intersecting edge 29 of the arcuate wall 27 and the flat wall 28. The opening 31 is positioned adjacent that edge of the intersecting wall that is in a raised position, as shown in FIG. 5, so that when tilted to an upright position, as shown in FIG. 4, it is still above the level of the liquid in the container 26 so that the fluid will not leak out from the opening 31 in either the upright stored position of FIG. 4 or the horizontal platform position of FIG. 5. The opening 31 has the sealable cap 32 but caps tend to leak and are not always tightened so that leakage frequently occurs at the opening. The bed may also have a counterweighting spring 34 connected to a base frame member 35 at one end and to an eyelet 36 on the platform 14 in the other end thereof.

Figure 1:
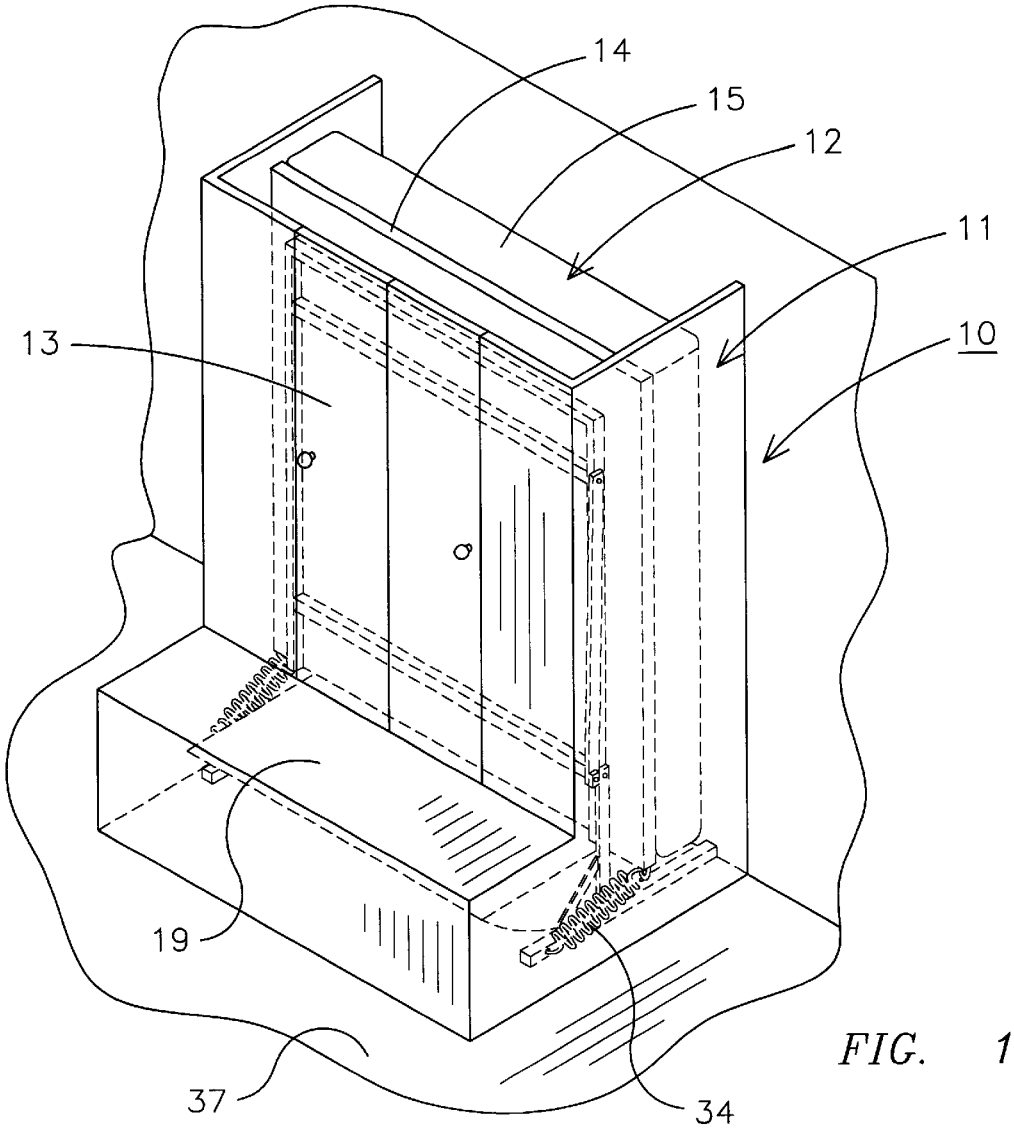
FIG. 1 is a perspective view of a stowable bed in accordance with the present invention stored in a cabinet.
Figure 2:
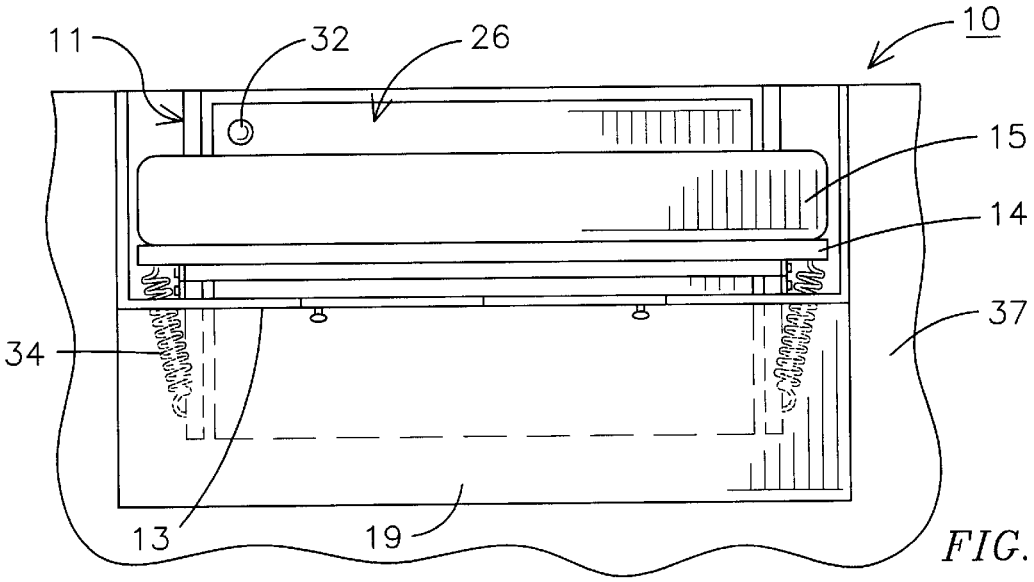
FIG. 2 is a top plan view of the stowable bed of FIG. 1.

In operation, the stowable bed 12 stored in the cabinet 11, as shown in FIGS. 1 and 4, can have the cabinet doors 13 opened and the bed tilted to a horizontal position, as shown in FIGS. 3 and 5. The legs 17 drop when the bed is pulled from the cabinet to support the bed on the floor 37. Once the bed has been used, it can be easily lifted back to the storage position of FIGS. 1 and 4. The liquid 30 can be removed from the container 26 to reduce the weight and can be refilled when placed in a new position. It can easily be refilled from a stored position, as seen in FIG. 4, or in an operative position, as seen in FIG. 5. The spring 24 can also act as an additional counterweighting force.

It should be clear at this time that a Murphy type bed has been provided which advantageously utilizes a fluid container that can be filled with water or the like for counterbalancing the bed, which tank can be emptied for moving or shipping of the bed. However, the present invention should not be considered as limited to the forms shown which are to be considered illustrative rather than restrictive.

I claim:

1. A bed pivotable from a horizontal position to an upright position comprising:

a base frame;

a mattress supporting platform having two end portions and being hinged to said base frame for pivoting between a generally horizontal position and a generally upright position; and a counterweight container having a generally flat side intersected along two edges by a generally arcuate side, said container having a sealable opening adjacent one said intersecting edge of said flat and arcuate sides for filling said container with a fluid material, said sealable opening being positioned above the fluid material in said container in said horizontal or generally upright position to thereby prevent leakage from sealable opening;

whereby a storable bed has a fillable container counterweight having an opening positioned to avoid spilling any fluid contained therein.

2. The bed in accordance with claim 1 including a counterbalancing spring connected between said platform one end portion and said base frame for adding additional counterbalancing force to said bed.

3. The bed in accordance with claim 2 in which said platform has a pair of foldable legs attached thereto for supporting one end of said platform in a horizontal position and foldable into a storage position when said platform is in a generally upright position.

4. The bed in accordance with claim 3 including a cabinet having said base frame mounted therein and shaped to receive said platform in an upright storage position.

* * * * *